US006715961B2

(12) United States Patent
Kennedy et al.

(10) Patent No.: US 6,715,961 B2
(45) **Date of Patent: *Apr. 6, 2004**

(54) METHOD OF SUPPORTING MINE WALLS AND INSTALLING A MINE STOPPING

(75) Inventors: William R. Kennedy, Taylorville, IL (US); John M. Kennedy, Taylorville, IL (US)

(73) Assignee: Jack Kennedy Metal Products & Buildings, Inc., Taylorville, IL (US)

( * ) Notice: Subject to any disclaimer, the term of this patent is extended or adjusted under 35 U.S.C. 154(b) by 71 days.

This patent is subject to a terminal disclaimer.

(21) Appl. No.: 10/061,146

(22) Filed: Feb. 1, 2002

(65) Prior Publication Data

US 2002/0098046 A1 Jul. 25, 2002

Related U.S. Application Data

(63) Continuation-in-part of application No. 09/464,808, filed on Dec. 17, 1999, now Pat. No. 6,379,084.

(51) Int. Cl.[7] ..... E21F 1/14

(52) U.S. Cl. ..... 405/132; 299/12; 454/169; 248/354.4

(58) Field of Search ..... 405/132, 272, 405/273, 277, 288, 133, 134, 192, 157; 454/169, 168; 299/11, 12; 248/351, 354.1, 354.4; 52/217

(56) References Cited

U.S. PATENT DOCUMENTS

| | | | | |
|---|---|---|---|---|
| 251,698 | A | | 1/1882 | Coats et al. |
| 617,163 | A | | 1/1899 | Jacobs |
| 891,897 | A | | 6/1908 | Astrom |
| 1,478,303 | A | | 12/1923 | Snyder |
| 1,594,921 | A | | 8/1926 | Barnett |
| 2,350,113 | A | | 5/1944 | Hurley |
| 2,729,064 | A | | 1/1956 | Kennedy et al. |
| 3,186,177 | A | | 6/1965 | Kannenberg |
| 3,851,856 | A | | 12/1974 | Berg |
| 3,937,026 | A | | 2/1976 | Krings |
| 3,969,852 | A | | 7/1976 | Krings |
| 3,972,272 | A | | 8/1976 | Bagby |
| 4,054,033 | A | | 10/1977 | Pillosio |
| 4,345,857 | A | | 8/1982 | Krings |
| 4,547,094 | A | | 10/1985 | Kennedy et al. |
| 4,685,837 | A | | 8/1987 | Cicanese |
| 4,820,081 | A | | 4/1989 | Kennedy et al. |
| 4,911,577 | A | | 3/1990 | Kennedy et al. |
| 5,167,474 | A | | 12/1992 | Kennedy et al. |
| 5,215,411 | A | | 6/1993 | Seegmiller |
| 5,222,838 | A | | 6/1993 | Kennedy et al. |
| 5,611,514 | A | * | 3/1997 | Oliver et al. ..... 405/288 |
| 5,813,647 | A | | 9/1998 | Chen |

FOREIGN PATENT DOCUMENTS

| | | | | |
|---|---|---|---|---|
| CA | 2328552 | | 6/2001 | |
| FR | 2610986 | * | 8/1988 | ..... 299/12 |

OTHER PUBLICATIONS

Kennedy Interlocking Overcasts brochure, Jack Kennedy Metal Products & Buildings, Inc., Nov. 6, 2000.
Kennedy Steel Stoppings brochure, Jack Kennedy Metal Products & Buildings, Inc., Aug. 9, 2002.

* cited by examiner

*Primary Examiner*—Frederick L. Lagman
(74) *Attorney, Agent, or Firm*—Senniger, Powers, Leavitt & Roedel

(57) ABSTRACT

A method of supporting opposite first and second walls of a mine passageway includes providing an elongate beam having opposite first and second ends and a longitudinal axis. The beam is configured to have substantial columnar strength for bearing a substantial longitudinal load applied to the beam generally longitudinally of the beam and substantial bending strength for bearing a substantial transverse load applied to the beam generally transversely of the beam. The method further includes selecting first and second locations on the first and second walls, respectively, providing suitable areas for supporting the first and second walls, and positioning the first end of the beam at the first location and the second end of the beam at the second location so that the beam extends between the first and second walls of the mine passageway.

30 Claims, 7 Drawing Sheets

METHOD OF SUPPORTING MINE WALLS AND INSTALLING A MINE STOPPING

CROSS-REFERENCE TO RELATED APPLICATION

This is a continuation-in-part of U.S. patent application Ser. No. 09/464,808 filed Dec. 17, 1999, now U.S. Pat. No. 6,379,084 which is incorporated herein by reference.

BACKGROUND OF THE INVENTION

This invention relates to a method of supporting mine walls in a mine passageway and to a method of installing a mine stopping.

Mine stoppings are widely used in mine passageways to stop off the flow of air therethrough. A conventional metal stopping shown in U.S. Pat. No. 4,483,642 comprises a plurality of elongate extensible panels 7 extending vertically from the floor to the roof of the mine passageway and positioned in side-by-side relation across the passageway. (See FIG. 1 of the patent.) The mine walls of the passageway tend to shift over time (especially coal mine walls), generally moving closer together from the weight of the overburden. Shifting tends to cause cracking and sloughing off of large portions of the mine walls, which can result in the leakage of air past the aforementioned stopping. Such leakage increases the operating cost of a mine, since more fresh air must be pumped into the mine.

A conventional metal stopping as disclosed in the aforementioned patent is typically constructed by embedding ends of elongate bars 3 in the mine walls. The bars include two or more overlapping steel angles which are slidable relative to one another and held in place by ties or tape. (See FIG. 2 of the patent). The telescoping panels are positioned side-by-side so that they are in contact with the bars. An upper member 17 of each telescoping panel 7 is extended relative to a lower member 13 of the panel so that it engages the roof of the mine, and the upper and lower members are held in place by wire ties 9 secured to the bars 3.

The elongate bars of the conventional metal stopping provide little or no support to the mine walls. The ends of the bars are typically either embedded in holes in the walls or placed on shelf formations on the walls. In either case, the cross-sectional area presented by the ends of the bars is too small to provide significant lateral support to the walls. Moreover, since the frictional forces exerted by the wire ties is relatively small, the bars will slide relative to one another when subjected to relatively small compressive loads (e.g., 500 pounds are less). These loads are not sufficient to provide significant support to the walls, as during a mine convergence. Some prior art angles are bolted together so that the angles cannot slide. (See FIG. 1 of U.S. Pat. No. 2,729,064.) However, such non-yielding angles simply penetrate the mine walls upon convergence, thereby providing little or no support to the mine walls.

SUMMARY OF THE INVENTION

Among the several objects of this invention may be noted the provision of a method that inhibits cracking and sloughing off of opposing mine walls; the provision of such a method that reduces ventilation air leakage in the mine; the provision of such a method that provides yieldable support to the mine walls; the provision of such a method that is cost effective; and the provision of such a method which involves the installation of a mine stopping.

The present invention is also directed to a method of installing a mine stopping that is easy to perform, and the provision of such a method wherein the mine stopping is adapted to withstand significant loading caused by air pressure and by convergence of the mine walls.

In one aspect, the invention is directed to a method of supporting opposite first and second walls of a mine passageway including providing an elongate beam having opposite first and second ends and a longitudinal axis. The beam is configured to have substantial columnar strength for bearing a substantial longitudinal load applied to the beam generally longitudinally of the beam and substantial bending strength for bearing a substantial transverse load applied to the beam generally transversely of the beam. The method further includes selecting first and second locations on the first and second walls, respectively, providing suitable areas for supporting the first and second walls, and positioning the first end of the beam at the first location and the second end of the beam at the second location so that the beam extends between the first and second walls of the mine passageway. The method also includes securing the first end of the beam to the first wall at the first location and the second end of the beam to the second wall at the second location so that the beam is positioned for supporting the first and second walls.

In another aspect of the invention, a method of supporting opposite first and second walls of a mine passageway includes providing an elongate beam having opposite first and second ends and a longitudinal axis wherein each end of the beam has a bearing member thereon for bearing against a respective wall. The bearing member has a bearing surface area greater than the cross-sectional area of the beam. The beam is configured to have columnar strength for bearing a longitudinal load of at least 800 pounds applied to the beam generally longitudinally of the beam and bending strength for bearing a transverse load caused by an air pressure of at least two inches water gauge and applied to the beam generally transversely of the beam. The beam includes a central beam and a slide member slidable relative to the central beam. The method further includes selecting first and second locations on the first and second walls, respectively, providing suitable areas for supporting the first and second walls. The first end of the beam is positioned at the first location and the second end of the beam is positioned at the second location by sliding the slide member relative to the central beam to adjust the length of the beam to correspond to the distance between the first and second walls so that the beam extends between the first and second walls of the mine passageway. The bearing member of the first end of the beam is secured to the first wall at the first location and the bearing member at the second end of the beam is secured to the second wall at the second location so that the beam is positioned for supporting the first and second walls.

In yet another aspect of the invention, a method of installing a mine stopping between the first and second walls of a mine passageway includes providing an elongate beam having opposite first and second ends and a longitudinal axis. The beam is configured to have substantial columnar strength for bearing a substantial longitudinal load applied to the beam generally longitudinally of the beam and substantial bending strength for bearing a substantial transverse load applied to the beam generally transversely of the beam. The first end of the beam is positioned at a first location on the first wall and the second end of the beam is positioned at a second location on the second wall so that the beam extends between the first and second walls of the mine passageway. The method further includes securing the first end of the beam to the first wall at the first location and the second end of the beam to the second wall at the second location so that the beam is positioned to take a substantial longitudinal load.

A stopping is erected to extend between the first and second walls after the beam has been secured to the walls. The erecting step includes securing the stopping to the beam so that a load applied to the stopping due to an air pressure differential across the stopping is transferred to the beam as a transverse load.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
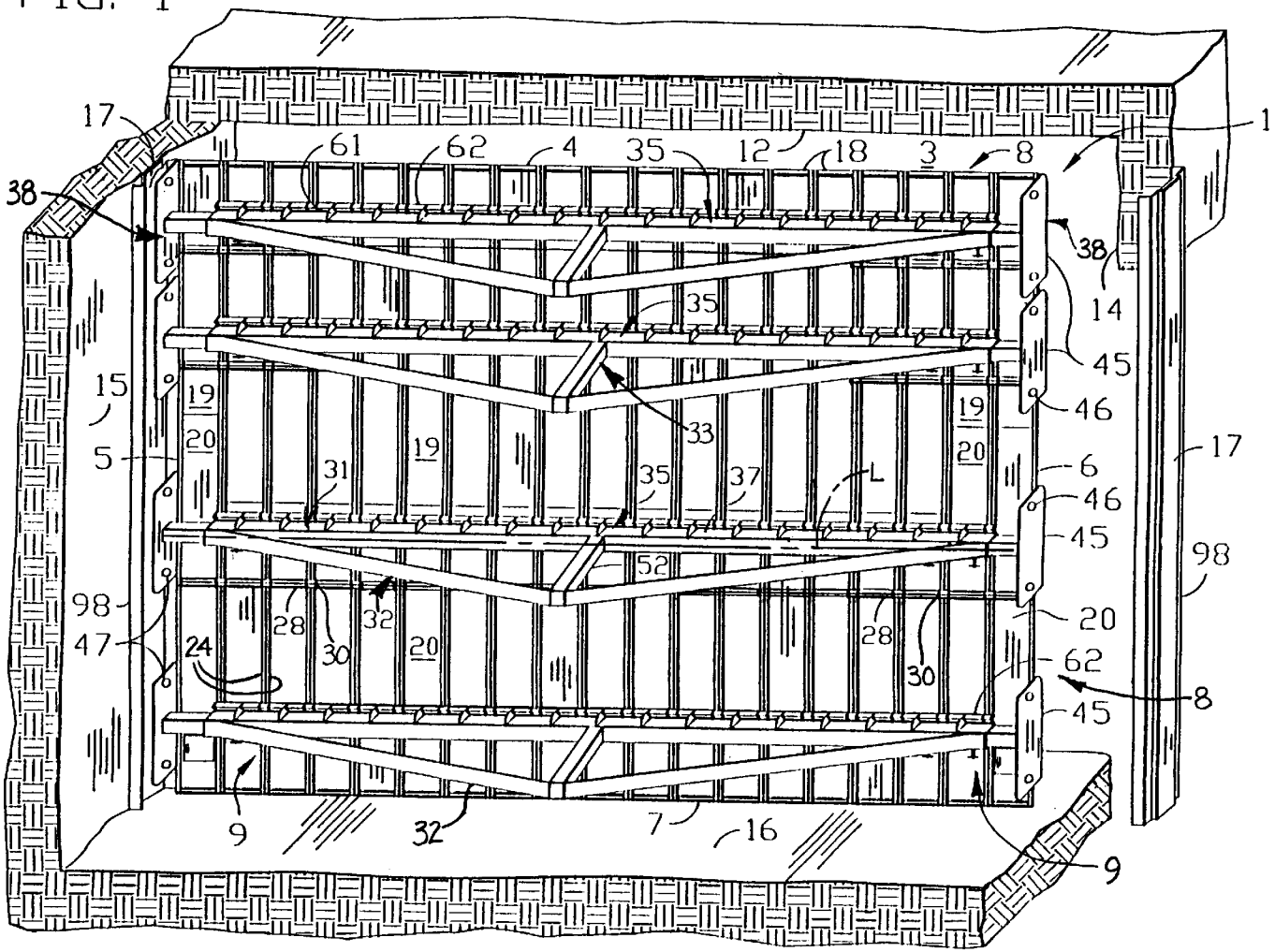
FIG. 1 is a fragmentary perspective view of a mine stopping in a mine with the stopping having a plurality of reinforcing braces secured thereto with optional side channels shown exploded.

Referring to FIG. 1, the numeral 1 generally designates a high pressure stopping system of an embodiment of this invention adapted for use in mines to at least partially close a mine passageway 3. The system can be used to substantially or partially seal the passageway against air flow therethrough. In this embodiment, the stopping system 1 is used to substantially seal against air flow creating a pressure differential across the stopping system 1 with a normally high pressure side 8 and a normally low pressure side 9. This pressure differential applies force to the stopping system 1 in the direction of the higher pressure side 8 toward the lower pressure side 9. In use of the system, it is to be understood that the high pressure side 8 and the low pressure side 9 may switch under certain circumstances but are normally in one orientation. Sealing can be accomplished by having the top edge 4, side edges 5, 6 and bottom edge 7 of the stopping system adjacent to the top or roof 12, opposite side walls 14, 15 and the floor 16, respectively, and having suitable sealing material 17 (e.g., polymeric foam such as polyurethane and polystyrene) therebetween.

Figure 9:
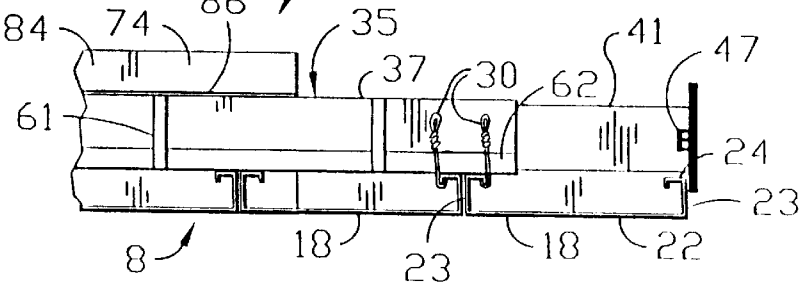
FIG. 9 is an enlarged fragmentary sectional view of the stopping system taken along the line 9—9 of FIG. 7.

The stopping system 1 of this embodiment includes a plurality of stopping panels 18 positioned in side-by-side relation and extending vertically in the mine passageway 3. The stopping panels 18 can be of any suitable style, e.g., each one can be fabricated as a single piece panel or as a pair of panel sections 19 and 20 (FIG. 1) which are preferably channel shaped (FIG. 9) in transverse cross section. The panel sections 19 and 20 are slidably or telescopically connected, i.e., one fits within the other and can move coaxially relative to one another to form a telescoping stopping panel 18 as exemplified in U.S. Pat. Nos. 4,547,094, 4,820,081 and 4,911,577, which are incorporated herein by reference. As best seen in FIG. 9, the panel sections 19, 20 have a channel-shaped transverse cross section with a panel web portion 22, opposing flanges 23 and inturned legs 24. The panel sections 19 and 20 are preferably of the same shape with one being smaller than the other so the smaller one will fit within the larger one for connection and telescoping movement. Preferably, the panels 19, 20 are metal, preferably steel.

When the panels 18 are installed in a mine, they are positioned in side-by-side relation and are extended in length to provide the desired height. The panels 18 are suitably secured in position in the mine passageway 3 in side-by-side relation. Such securement can be by any suitable means and helps prevent substantial relative movement between adjacent side-by side panels 18. As shown in FIG. 1, rib angles or bars 28 are placed against the legs 24 of the panels 19, 20 and are secured thereto as for example by twist wires 30 or any other suitable means. Note that the bars 28 may be omitted if the stopping is constructed by first installing a brace, as further described below. Others of the panels 18 are secured using rib members attached to braces described below.

Figure 2:
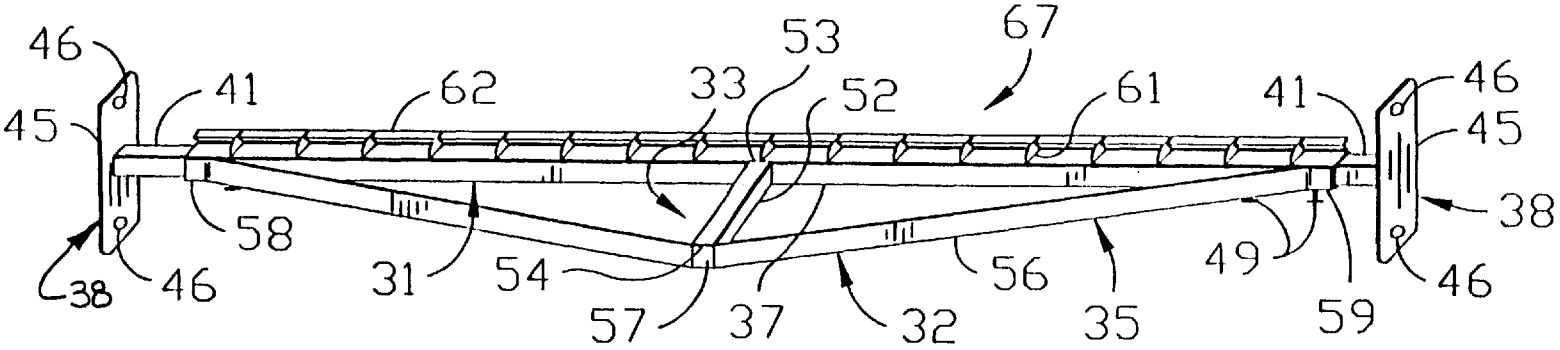
FIG. 2 is a perspective view of a reinforcing brace.
Figure 3:
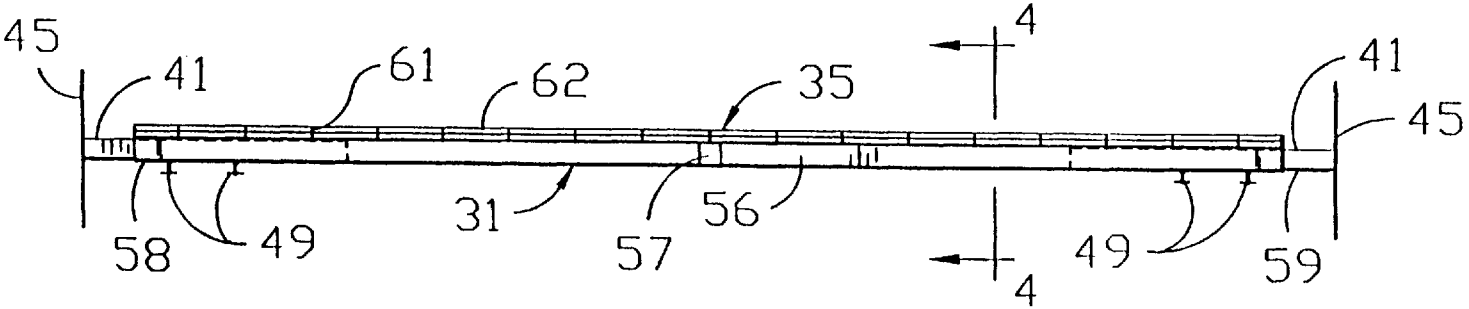
FIG. 3 is side elevation view of a reinforcing brace.
Figure 4:
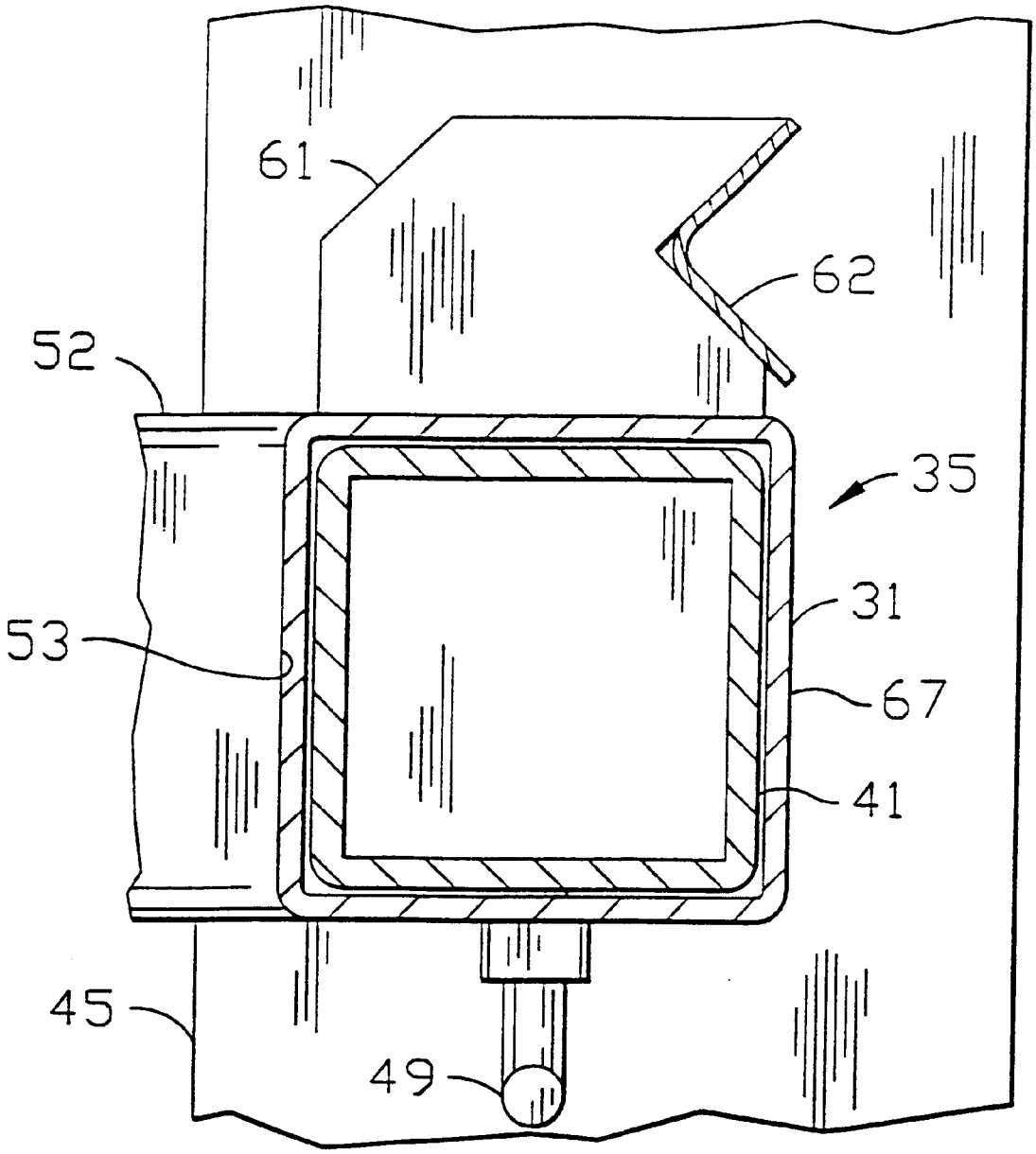
FIG. 4 is an enlarged sectional view of the reinforcing brace taken alone the line 4—4 of FIG. 3.

Referring now to FIGS. 1 and 2, the stopping system 1 includes one or more horizontal reinforcing braces 35 which are preferably extensible or variable in length. In one embodiment, each brace 35 includes a compression chord (generally, elongate beam) designated generally 31, a tension chord designated generally 32 and a web designated generally 33 extending between the compression chord 31 and the tension chord 32. Alternatively, as described in parent application Ser. No. 09/464,808, the brace may include only the compression chord 31. When more than one horizontal brace 35 is used in a stopping system 1, the braces are spaced apart vertically and are preferably generally parallel. Anchor means 38 is preferably provided for mounting or securing the brace 35 to the mine wall. However, the anchor means may be omitted without departing from the scope of this invention.

Each compression chord 31 has opposite first and second ends and a longitudinal axis L. The compression chord 31 comprises at least one central support member or central beam 37. In the embodiment of FIGS. 1–10, there is one central beam 37. Length adjustment or variation is provided by having at least one slide member 41 mounted on the central beam 37 for telescoping movement. As shown, the central beam 37 is tubular having a rectangular transverse cross section with inside dimensions. The slide member 41 has a corresponding rectangular transverse cross section with outside dimensions slightly smaller than the inside dimensions of the central beam 37 and is slidably received therein for telescoping movement. It is to be understood that the cross sectional shape of the central beam 37 can vary, e.g., it may have an I-beam shape. Moreover, the central beam 37 may be sized smaller in cross section than the slide members 41 so that the central beam is received in ends of the slide members. The shape of the slide member 41 preferably corresponds to the central beam, but may differ therefrom within the scope of this invention. Preferably a slide member 41 is mounted in each of the two opposite ends of the central beam 37 permitting length adjustment or variation of the compression chord 31 at both ends of the central beam 37. The illustrated embodiment shows the use of two slide members 41 in a central beam 37; however, only one slide member may be used. The length of the slide members 41 should be such that they will accommodate the maximum amount of mine wall divergence without disengaging from the central beam 37. During cycles of mine wall convergence and divergence, the central beam 37 could work completely to one side of the mine passageway. Thus, the slide member 41 on the opposite end of the central support member is preferably long enough to prevent disengagement from the central beam 37. Additionally, sufficient lengths of the slide members 41 are preferably disposed in the central beam 37 to provide the necessary strength for the brace 35 to support the anticipated loads on the brace.

The anchor means 38 is operable to retain the brace 35 in position relative to the side walls 14, 15 when the walls converge and diverge causing load to be applied to the stopping 1. The anchor means 38 is affixed to an exteriorly positioned free end of each of the slide members 41 in a manner that will allow tension and compression to be applied to the slide member from the side walls 14, 15. The anchor means 38 is preferably operable to allow for or effect both expansion and contraction of the length of the brace 35 and maintain the brace secured to the mine walls. The anchor means 38 is secured to a mine wall to prevent movement of the brace 35 relative to or along the mine passageway. In one embodiment, the anchor means 38 includes a plate 45 connected or secured to the exteriorly positioned free end of each of the slide members 41. The plate 45 lies in a plane that is generally perpendicular to the longitudinal axis of the respective slide member 41. As shown in FIGS. 1 and 2, the plate 45 has a bearing surface area significantly greater than a cross-sectional area of the slide member 41 and of the central beam 37. The plate 45 typically has a surface area between about 0.25 and 2.5 square feet and such area is about 2 to 25 times greater than that of the slide member 41 and beam 37. The plate 45 may have apertures 46 for receiving appropriate fasteners 47, such as anchor bolts, conventional roof bolts, or threaded studs. The fasteners 47 are inserted into the apertures 46 and into holes in the side walls 14, 15. If threaded studs are used, the plate 45 is hung on the studs, and nuts are threaded onto respective studs to retain and secure the plate. Rather than separable fasteners, the plate may include a claw (not shown) for extending into the side walls 14, 15. Other forms of anchor means 38 could be used, and the plate 45 may be omitted, e.g., if the cross-sectional area of the beam is sufficient to support the wall. The bearing surface area in contact with the wall is preferably at least about 16 square inches, more preferably at least about 40 square inches, and even more preferably at least about 300 square inches. If the plate 45 is omitted, the exteriorly positioned end of the slide member 41 or of the brace 35 (if the slide member is omitted) may be secured directly to the walls 14, 15 by fasteners 47. The fasteners 47 of the anchor means 38 can also include brackets, clamps, claws or the like that are secured to the brace 35 and the mine walls 14, 15. Further, the plate member 45 could have a separable clevis type mount (described more fully in the parent application). It is contemplated that the fasteners be made integral with the brace 35, e.g., by making the fasteners integral with the plate 45.

Retaining means is also provided to restrict telescoping movement of the slide members 41 in the central beam 37. As shown, the retaining means preferably comprises friction lock means including, in one embodiment, T-handled set screws 49 that are threadably mounted in the central support member 37. When the set screws 49 are tightened, they engage respective slide members 41 and frictionally retain the slide members 41 in their initial adjusted position or a subsequent position due to wall movement. The friction between the set screws 49 and the slide members 41 resists relative telescoping of the central beam 37 and slide members 41 so that the compression chord 31 is configured to have substantial columnar strength for bearing a substantial longitudinal load (i.e., axial or eccentric loading relative to the longitudinal axis L) applied to the chord. Thus, the brace is sufficiently unyielding so as to provide substantial support to the side walls 14, 15. Substantial convergence or divergence of the side walls 14, 15 overcomes the frictional force causing telescoping movement of the slide members 47 relative to the central beam 37. The slide member 41 is locked relative to the central beam 37 such that the slide member will resist a substantial longitudinal load without yielding or sliding relative to the central beam. More specifically, the slide member will resist without yielding under a longitudinal load of at least about 800 pounds, more preferably at least about 4000 pounds, even more preferably at least about 8000 pounds, and even more preferably at least about 16,000 pounds. Such sliding or telescoping movement does not inelastically deform the central beam 37 or the slide members 41 and does not alter their structural integrity. Because the engagement is frictional, should the mine walls move after installation of the brace 35, the slides 41 will still be able to move in either an extension or contraction direction relative to the central beam 37. This relative movement prevents excessive axial or longitudinal loading of the central beam 37 and the slide members 41 so that inelastic deformation of the compression chord 31 is inhibited.

As an example, a cup point set screw of .625 inches diameter has a longitudinal holding force of about 4000 pounds (*Mark's Handbook for Mechanical Engineers*, page 8–23, 8th edition, 1978). Thus, in the configuration of FIG. 1 where two cup point set screws 49 engage each slide member 41, the slide members will provide resistance without yielding or sliding under a longitudinal load of at least about 8000 pounds. Similarly, if the configuration is changed so that four set screws 49 engage each slide member 41, the slide members will resist a longitudinal load of at least about 16,000 pounds. Thus, the compression chord 31 has substantial columnar strength for bearing a substantial columnar load (e.g., at least about 800 pounds, more preferably at least about 4000 pounds, even more preferably at least about 8000 pounds, and even more preferably at least about 16,000 pounds), but the slide member 41 will slide under a predetermined load such that the compression chord 31 is not damaged. As will be understood, the frictional resistance force may be accurately controlled by including any number, type or size of set screws.

The brace 35 has substantial bending strength for bearing a substantial transverse load applied to the beam generally transversely of the beam. Such load is typically applied by the air pressure differential acting against the mine stopping system 1 and transferred to the brace 35. Preferably, the brace 35 is sized for an exemplary sized stopping system 1 having a width of 20 feet and a height of 15 feet so that it does not inelastically yield under a transverse load caused by a pressure differential of at least about 2 inches water gauge, more preferably at least about 5 inches water gauge, more preferably at least about 10 inches water gauge, and even more preferably at least about 20 inches water gauge. For another exemplary sized stopping system 1 having a width of 40 feet and a height of 30 feet, the brace 35 is sized so that it does not inelastically yield under a transverse load caused by a pressure differential of at least about 2 inches water gauge, more preferably at least about 5 inches water gauge, more preferably at least about 10 inches water gauge, and even more preferably at least about 20 inches water gauge. Note that the brace 35 and each panel 18 will be stressed due to the air pressure differential and will deflect a distance due to the air pressure differential (the transverse load). Preferably, the stiffness of the brace 35 and stiffness of the panels 18 are selected so that the brace and panels are similarly stressed when the stopping system 1 is placed under the transverse load. More specifically, the point of extreme fiber stress in the brace generally occurs midway across the passageway, and such extreme fiber stress is substantially similar to extreme fiber stress in the panels 18 that are positioned midway across the passageway. The point of extreme fiber stress in the panels 18 is likely to be adjacent the point of extreme fiber stress in the brace. Extreme fiber stress is local stress through a small area (a point or a line) furthest from the neutral axis or centroid on the brace or the panels 18, and is typically measured in pounds per square inch (psi). More specifically, for panels 18 positioned generally midway across the passageway, extreme fiber stress in the panels is at least about 40 percent, more preferably about 60 percent, even more preferably about 80 percent, of the extreme fiber stress in the brace when the transverse load is applied to the stopping so that the beam and the panels are both effective to resist the transverse load. For example, if the brace 35 has an extreme fiber stress of 10,000 psi due to the transverse load, then the extreme fiber stress in the adjacent panels is at least about 4000 psi, more preferably at least about 6000 psi, and even more preferably at least about 8000 psi. Also note that the brace and panels will deflect similar distances under similar loads. By stressing the panels 18 and brace 35 similarly, overstressing one or the other beyond their respective yield points is inhibited. Moreover, material used in the panels 18 and brace 35 is not wasted as would be the case if only one of the panels and brace was significantly stressed by the transverse load. For example, if the brace 35 did not carry a significant portion of the transverse load, then the material therein would be wasted with respect to resisting the transverse load.

In the illustrated embodiment, the brace 35 is in the form of a king post truss. As shown in FIG. 2, the web 33 includes a compression member such as a king post 52, having opposite ends 53 and 54. The king post 52 is mounted generally centrally of the central beam 37. It has one end 53 adjacent to and suitably secured to the central beam 37 adjacent the center thereof such as by welding. The king post 52, as shown, has a generally rectangular transverse cross section and can be tubular. The other end 54 is positioned a distance from the central beam 37. The king post 52 can be generally perpendicular to the central beam The tension chord 32 is a tension or brace member that has opposite end portions 58, 59 and a center portion 57. The end portions 58, 59 are positioned adjacent opposite ends of the central beam 37 and are suitably secured thereto, as by welding. The end 54 of the king post 52 engages the center portion 57 and is preferably suitably secured thereto, as by welding. The tension chord 32 can be made from a flat metal strap and, when the truss 35 is in use, normal loading thereof will put the tension chord 32 in tension allowing for the use of a simple transverse cross section. When the brace 35 is loaded due to the pressure differential across the stopping, the loading force is directed from the front side 67 of the central beam 37 toward the end 54 placing the tension chord 32 in tension and the king post 52 in compression. If the pressure differential is reversed so that the force is directed from the opposite side of the central beam 37, the tension chord may be reconfigured to resist compression loading (i.e., so that the tension chord is instead a compression chord).

The brace 35 is provided with suitable securement means that is affixed to the central beam 37 for attaching or securing the brace 35 to the stopping panels 18. In one embodiment (FIG. 4), the securement means includes a plurality of uprights 61 (formed from metal plate, for example) suitably secured to the central beam 37 and spaced apart along the length thereof. An elongate panel securement member such as rib member 62, is suitably secured to the uprights 61 with the open side facing away from the brace 35 and toward the stopping panels 18. The rib member 62 is preferably a metal angle. Twist wires, clamps or other suitable means 30 can be used to secure the rib member 62 and hence the brace 35 to the stopping panels 18 (FIGS. 1, 8).

Figure 8:
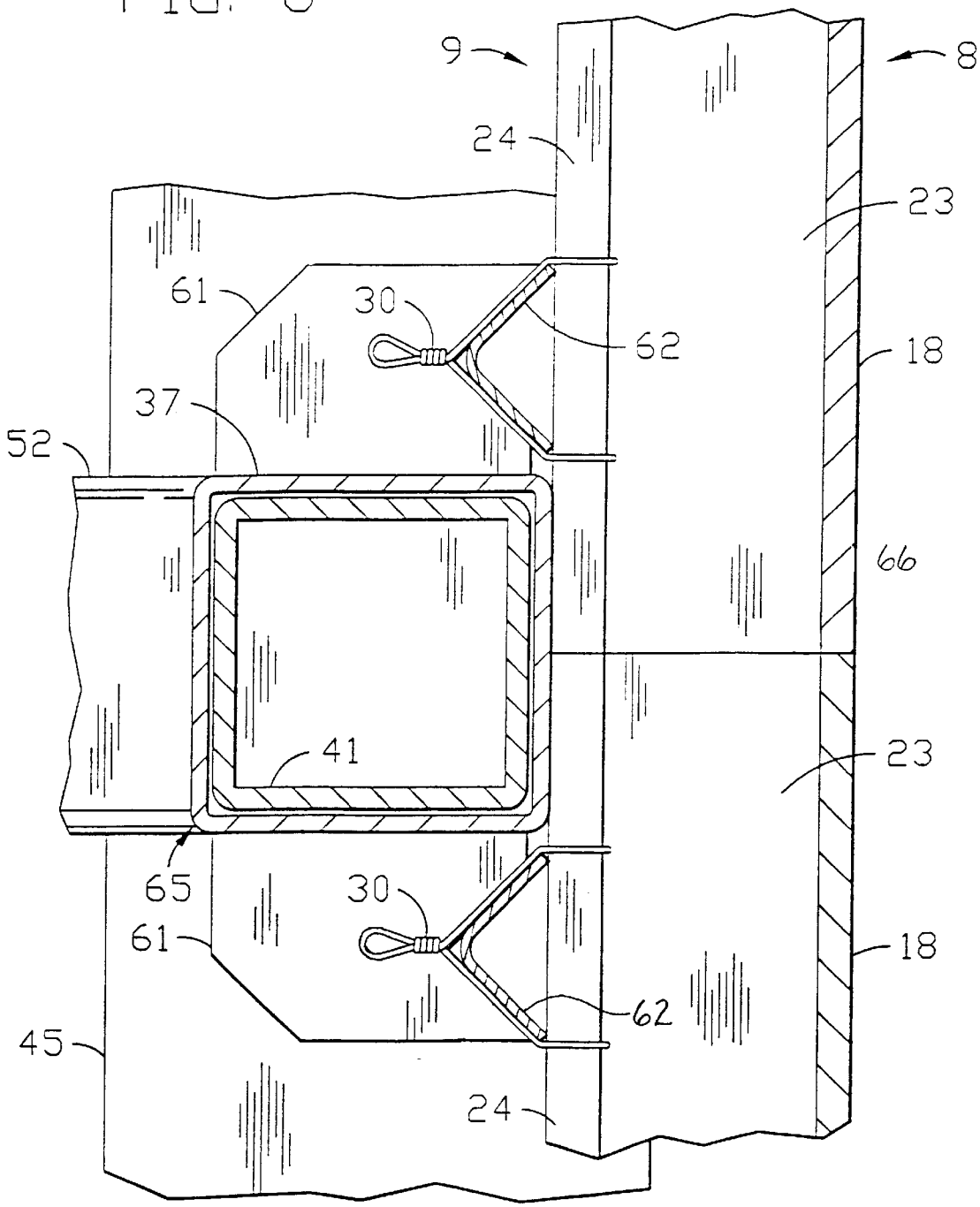
FIG. 8 is a enlarged fragmentary end sectional view of another embodiment of the brace and stopping system.

A modified form of brace 35 and stopping system is illustrated in FIG. 8. The modified brace is designated generally as 65. It is the same as the brace 35 except that it uses two securement members which are shown as upper and lower sets of uprights 61 and rib members 62. The rib members 62 and sets of uprights 61 are positioned on opposite sides of the central beam 37 whereby the two rib members 62 are spaced apart in positions above and below the central beam 37. In this embodiment, the brace 65 can be used at a joint between two sets of stopping panels 18 to secure them in end-to-end abutting relation allowing the use of shorter stopping panels 18. For example, two ten (10) foot sets of stopping panels 18 can be used instead of one twenty (20) foot set of stopping panels 18. The joint 66 between the two sets of stopping panels 18 is located between the two rib members 62. The brace 65 is secured to the stopping panels 18 as described above for the brace 35 with clamps or twist wires 30. If desired, one or more braces 35 can be used along with the brace 65 on a stopping system 1 for additional reinforcement.

As seen in FIG. 1, the stopping system can utilize one or more braces 35 secured thereto in a generally horizontal orientation. The braces 35 are secured to the stopping panels 18 on the normally low pressure side of the stopping system to reduce bending or deformation of the stopping system. Such mounting and loading places the tension chord 32 in tension. The generally V-shape of the brace 35 results in a smaller quantity of material being needed to provide the required strength. Also, the general V-shape of the brace 35 results in the brace having a higher or larger moment of inertia at the center of the brace 35 than at its opposite ends. Further, in the V-shape form of brace 35, the moment of inertia continuously increases from adjacent each end of the brace toward the central area of the brace 35 where it is at a maximum.

A modified form of the invention is shown in FIGS. 5, 6, 7 and 9. In this form, a stopping system 71 is provided with a selectively openable door 70 that will allow passage of personnel or equipment thru the stopping system and/or the controlled passage of air therethrough.

The stopping system 71 includes a door frame means 72 comprising spaced apart generally vertical columns 73 and a header or lintel 74 spaced from the floor 16 and roof 12 and secured to upper ends 75 of the columns 73. The columns 73 can have feet 76 that are adapted to be suitably secured to the floor 16 by fasteners 77 to prevent movement of the columns on the floor 16 and along the mine passageway 3. The columns 73 preferably have a height less than the height of the roof. The columns 73 can have any suitable transverse cross section and preferably are tubular with a generally rectangular transverse cross section.

Figure 7:
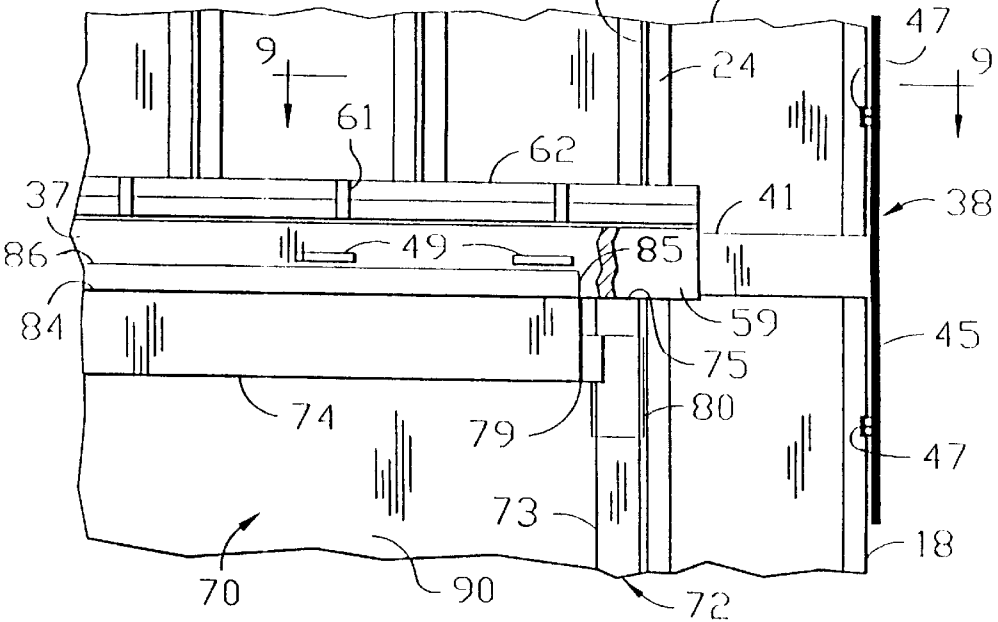
FIG. 7 is an enlarged fragmentary view of the lintel and column shown in FIG. 5.

The lintel 74 is suitably secured to the columns 73 adjacent their upper ends 75. As shown in FIG. 7, the lintel has brackets 79 secured to opposite ends of the lintel 74, e.g., by welding. The brackets 79 are in turn suitably secured to sleeves 80 such as by welding. The sleeves 80 are tubular and are sized to slide over the columns 73 and to be adjustably secured in selected vertical position on the columns, e.g., by set screws 81. This mounting arrangement allows for adjustability of the components during installation. The lintel 74 can have any suitable transverse cross section and can be tubular with a generally rectangular transverse cross section. The lintel 74 has an upper disposed surface 84 with an upwardly opening channel member 85 secured (e.g., welded) thereto and extending along the length of the lintel 74. The channel member 85 is preferably generally U-shaped with two upstanding legs 86 defining an upwardly opening channel 87 (see FIG. 6).

Figure 5:
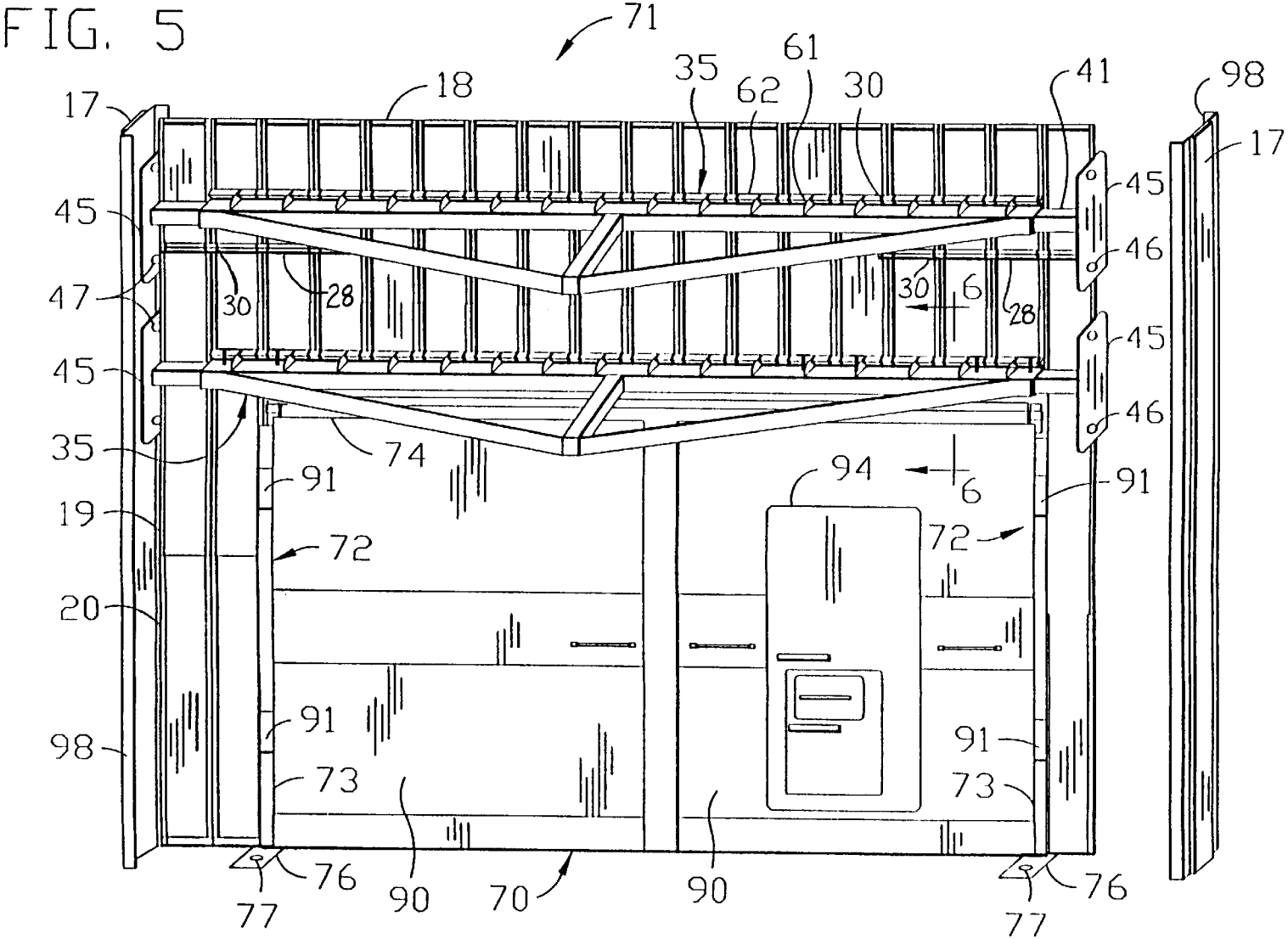
FIG. 5 is a perspective view of a stopping with a door unit with one side channel shown exploded.
Figure 6:
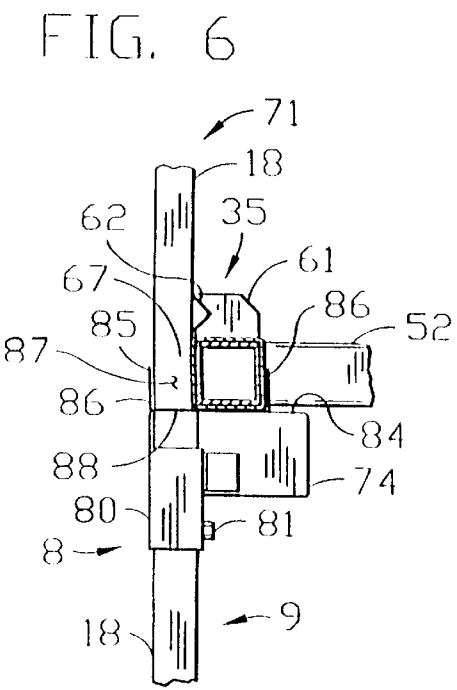
FIG. 6 is an enlarged fragmentary sectional view taken along the line 6—6 of FIG. 5 showing details of a lintel.

The stopping system 71 includes stopping panels 18 positioned between the columns 73 and the side walls 14, 15 and secured in place as described above. Shorter stopping panels 18 are positioned above the lintel 74, extending upwardly therefrom. The shorter stopping panels 18 are positioned between the lintel 74 and the roof 12 and are suitably secured together using bars 28 and twist wires 30. The lower disposed ends 88 of the stopping panels 18 above the lintel 74 are positioned in the channel 87 between the legs 86 to secure them against movement as described below. A brace 35 is also mounted or secured in the channel member 85 to reinforce the stopping system 71 in an area adjacent the lintel. The brace 35 reduces the amount of deflection or movement of the columns 73 and the lintel 74 during loading and thus eliminates the need for floor to roof columns. The central beam 37 of the brace 35 is placed in the channel 87 between the lower end portions 88 of the stopping panels and a leg 86 of the channel. The brace 35 and the stopping panels 18 above the lintel 74 are supported vertically by the lintel 74. The channel member 85 functions as a securement means associated with the brace 35 and the stopping panels 18 above the lintel 74 for tying the lintel to the central beam 37 and upper stopping panels 18 at a position adjacent to the lower ends 88 of the selected stopping panels. When the stopping system 71 deflects under load, the brace 35 is urged into frictional engagement with one leg 86 by the stopping panels 18 in the channel member 85. The channel member 85 thus secures or retains the selected stopping panels 18 above the lintel 74 and the brace 35 substantially immoveable relative to one another. As shown in FIG. 5, one or more additional braces 35 can be used on the stopping system 71.

The use of a lintel 74 and columns 73 changes the load distribution on the brace 35 relative to the form of the invention shown in FIG. 1 and should also help reduce deflection of the stopping system.

The door 70 can include one or more door panels or leaves 90 suitably moveably mounted on the columns 73 as for example by hinges 91. The leaves 90 can be retained closed by a suitable latch (not shown). One of the leaves 90 can have a man door 94 movably mounted thereon.

As seen in FIGS. 1 and 5, a pair of vertical anchor channels 98 can be mounted on the side walls 14, 15, as with anchor bolts (not shown), and be positioned between the plates 45 and the respective side wall 14, 15. These channels provide smoother surfaces than the walls 14, 15 and thus a better side fit for the stopping panels 18. Seal material 17 can be used between the stopping system 1 or 71 and the roof 12, side walls 14, 15 and the floor 16 of the mine passageway 3.

In a preferred embodiment, the stopping systems are constructed of metal, e.g., steel.

Figure 10:
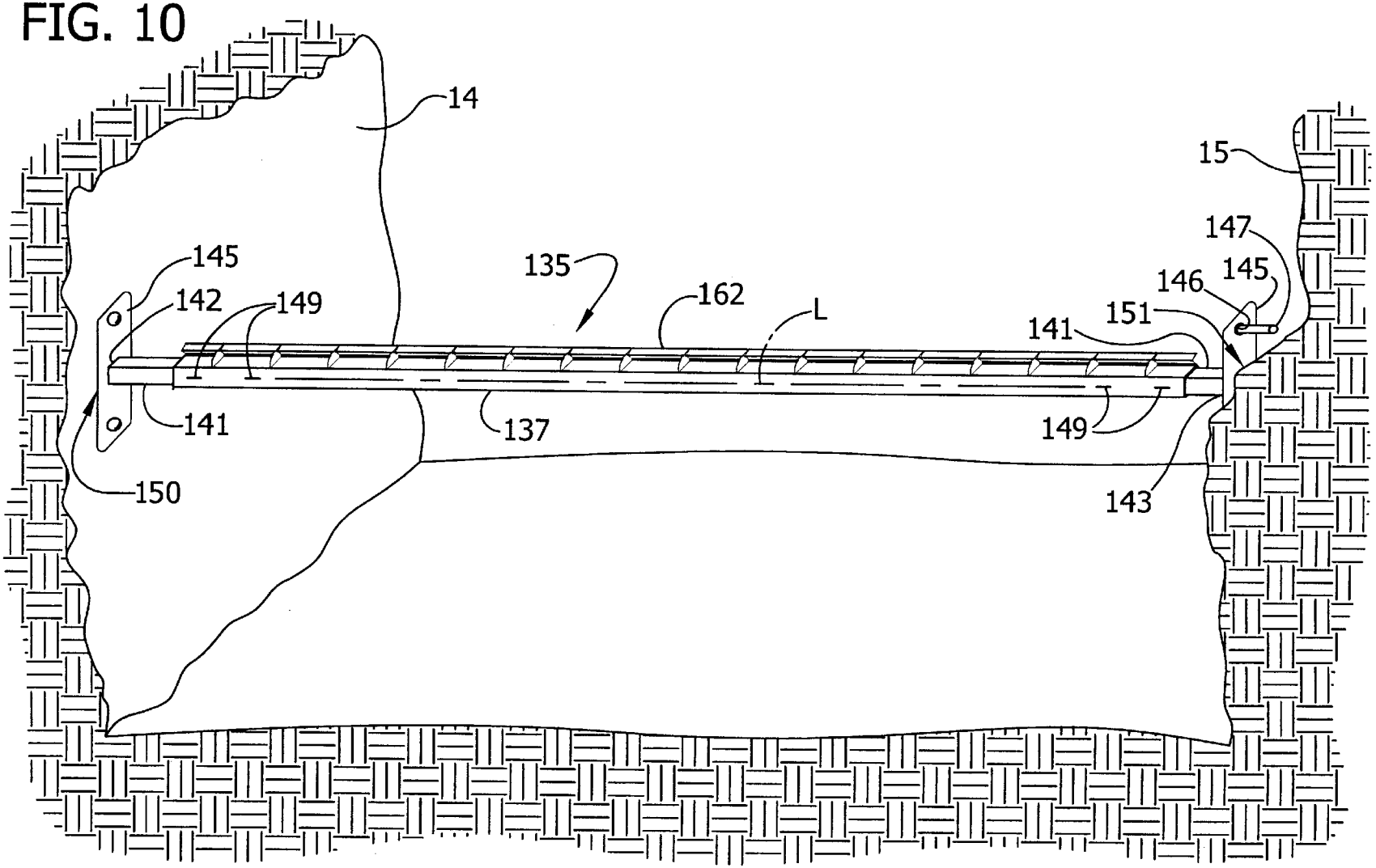
FIG. 10 is a fragmentary perspective view of a brace of another embodiment.

In an embodiment shown in FIG. 10, a brace 135 (generally, elongate beam) is used to support the side walls 14, 15 of the passageway 3. The brace 135 (similar to compression chord 31) has opposite first and second ends 142, 143 and a longitudinal axis L. The brace comprises a central beam 137, slide members 141 having anchor means (generally, bearing members) in the form of plates 145 on one end, and retaining means in the form of T-handled set screws 149. The central beam 137, slide members 141, anchor means and retaining means are substantially identical to those described above. However, the brace 135 of this embodiment does not include a compression chord or tension chord. Moreover, the stopping is not shown in FIG. 10 to illustrate that the brace 135, and the braces 35, 65 described above, may be used with or without the stopping to support the side walls 14, 15.

A method of supporting the side walls 14, 15 will be described with respect to brace 135, but the method is applicable to the braces 35, 65. In other words, the method applies to the embodiment of FIG. 10, to the embodiments described above, and to variations of these embodiments.

In one embodiment of this invention, first and second locations 150, 151, on the side walls 14, 15 (first and second walls), respectively, are selected to provide suitable areas for supporting the side walls. Suitable areas of the side walls 14, 15 preferably have little or no cracking and spalling and are not adjacent to areas of the walls that have sloughed off. The brace 135 is positioned by raising it from the floor and supporting it generally at the same elevation as the first and second locations and in an orientation generally transverse to the passageway 3. Lighter braces may be raised and supported by one or more persons, but heavier braces can be raised and supported using a fork lift, end loader, cribbing or other suitable means. The length of the brace 135 is adjusted to correspond to the distance between the side walls 14, 15 by sliding the slide members 141 relative to the central beam 137 to bring the plate 145 at the first end 142 of the brace into position at the first location 150 and the plate at the second end 143 into position at the second location 151. Optionally, the plates may be forced against the side walls 14, 15, as by a jack shown in U.S. Pat. No. 4,483,642, to pre-tension the brace. The plates 145 are then secured to the respective side walls 14, 15 using anchor bolts 147. Note that other suitable fasteners may be used, such as any of the fasteners described above. When using anchor bolts 147, holes are drilled in the side walls 14, 15, and the bolts are inserted into the apertures 146 and into the holes. Each slide member 141 is locked relative to the central beam 137 by tightening the set screws 149. Note that the brace 135 is selected to have the strength and yielding characteristics described above with respect to brace 35. Briefly, each slide member 141 is locked relative to the central beam 137 such that the slide member will resist a longitudinal load of preferably at least about 800 pounds, more preferably at least about 4000 pounds, more preferably at least about 8000 pounds and even more preferably at least about 16,000 pounds.

After the brace is secured, a stopping may optionally be erected between the side walls 14, 15. As described above, the stopping is erected by placing the stopping panels 18 side-by-side and extending the panels so that the lower panel section 20 engages the floor and the upper panel section 19 engages the mine roof 12, as described in U.S. Pat. No. 4,483,642 which is incorporated herein by reference. Preferably, each panel 18 of the stopping is secured to a rib member 162 of the brace 135.

It is contemplated that the braces 35, 65 and 135 may be non-extensible, i.e., the slide members may be omitted and the brace sized to fit a passageway of a known width. Even if the braces are non-extensible, the braces preferably do not inelastically yield under longitudinal load of at least about 800 pounds, preferably at least about 4000 pounds and more preferably about 8000 pounds.

The braces 35, 65 and 135 may be used to reinforce an existing stopping, i.e., the stopping panels are already in position when the brace is installed. Preferably though, the braces 35, 65, 135 are installed in the passageway prior to installing the panels 18, and the angle bars 28 are not used. Because the braces 35, 65, 135 are much more readily sized to fit the passageway, installation of the reinforced stopping system 1 is generally quicker and easier than the prior art method of erecting a stopping.

The braces 35, 65 and 135, and the described methods of installation, may also be used in combination with a pre-assembled stopping or pre-assembled stopping sections, as shown in our co-assigned U.S. patent application Ser. No. 09/903,429 filed Jul. 11, 2001, which is incorporated herein by reference.

The embodiments of the invention disclosed above are illustrative. Many variations of the mine stopping 1 and braces 35, 65, 135 are possible without departing from the scope of the invention. For instance, the brace 35 may have shapes other than the general V-shape shown in FIG. 10. For example, the brace may be generally rectangular. The cross sectional shapes of the components of the brace can also be different. For example, the tension chord 32 could be an angle member and the compression chord 31 and slide members 41 could be round or have an I-beam shape. Also, the slide members 41 need not telescope relative to the central beam 37.

The braces 35, 65, 135 will accommodate convergence and divergence of the mine and still be effective in supporting the stopping panels 18 against deflection from a pressure differential, and in supporting the mine walls 14, 15. The structure of the braces 35, 65, 135 allows them to self adjust to accommodate mine convergence and divergence while continuously supporting the walls to inhibit cracking and sloughing off. Such support reduces maintenance and operation costs. By having variable length, the braces can be used in mine passages of various widths increasing the versatility of application and thereby decreasing the number of different braces needed in inventory. The brace 65 further provides a simple means of joining together two tiers of stopping panels 18 stacked end on end, while also providing resistance to deflection of the stopping system 1 due to different pressures on opposite sides of the system.

When introducing elements of the present invention or the preferred embodiment(s) thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A method of supporting opposite first and second walls of a mine passageway, said method comprising the steps of:

providing an elongate beam having opposite first and second ends and a longitudinal axis, said beam being configured to have columnar strength for bearing a longitudinal load applied to the beam generally longitudinally of the beam and bending strength for bearing a transverse load applied to the beam generally transversely of the beam, the beam including a central beam and a slide member slidable longitudinally relative to the central beam, selecting first and second locations on the first and second walls, respectively, providing suitable areas for supporting the first and second walls, positioning the first end of the beam at said first location and the second end of the beam at said second location by sliding the slide member relative to the central beam to adjust the length of the beam to correspond to the distance between the first and second walls so that the beam extends between the first and second walls of the mine passageway, securing the first end of the beam to the first wall at said first location and the second end of the beam to the second wall at said second location so that the beam is positioned for supporting the first and second walls, and locking the slide member relative to the central beam so that the slide member will slide longitudinally relative to the central beam under a longitudinal load greater than about 800 pounds.

2. A method as set forth in claim 1 wherein at least one end of the beam has a bearing member thereon for bearing against a respective wall, said bearing member having a bearing surface area greater than the cross-sectional area of the beam, said securing step comprising securing the bearing member to a respective wall at said respective location.

3. A method as set forth in claim 1 wherein said securing step comprises fastening the respective ends of the beam to the respective walls using one or more fasteners.

4. A method as set forth in claim 3 wherein at least one end of the beam has a bearing member thereon for bearing against a respective wall, said bearing member having a surface area greater than the cross-sectional area of the beam, said fastening step comprising inserting at least one fastener of a respective set of fasteners through a hole in the respective wall, and then tightening the fastener so that the bearing member is in contact with the respective wall.

5. A method as set forth in claim 1 wherein the central beam and the slide member do not inelastically yield under a longitudinal load of at least about 800 pounds.

6. A method as set forth in claim 1 wherein the central beam and the slide member do not inelastically yield under a longitudinal load of at least about 4000 pounds.

7. A method as set forth in claim 1 wherein the slide member is locked relative to the central beam after the ends of the beam are secured to respective walls.

8. A method as set forth in claim 1 wherein the slide member is locked relative to the central beam such that the slide member will slide relative to the central beam under a longitudinal load greater than about 4000 pounds.

9. A method as set forth in claim 1 wherein the slide member is locked relative to the central beam such that the slide member will slide relative to the central beam under a longitudinal load greater than about 8000 pounds.

10. A method as set forth in claim 1 further comprising the step of erecting a stopping extending between said first and second walls after said beam has been secured to the walls.

11. A method as set forth in claim 10 wherein said erecting step includes securing the stopping to the beam.

12. A method as set forth in claim 11 wherein the beam does not inelastically yield under a transverse load caused by an air pressure of at least about two inches water gauge acting on said stopping.

13. A method as set forth in claim 11 wherein the beam does not inelastically yield under a transverse load caused by an air pressure of at least about five inches water gauge acting on said stopping.

14. A method as set forth in claim 11 wherein said stopping comprises a plurality of vertically extensible panels positioned side-by-side across the passageway, said erecting step comprising extending each of said panels to bring it into engagement with a floor and roof of the passageway, and then securing the panel in its extended position to said beam.

15. A method as set forth in claim 1 wherein said securing step comprises drilling holes in the first and second walls at said first and second locations, and using fasteners inserted in said holes to fasten the first and second ends of the beam to respective walls.

16. A method of supporting opposite first and second walls of a mine passageway, said method comprising the steps of:

providing an elongate beam having opposite first and second ends and a longitudinal axis, each end of the beam having a bearing member thereon for bearing against a respective wall, the bearing member having a bearing surface area greater than the cross-sectional area of the beam, said beam being configured to have columnar strength for bearing a longitudinal load of at least 800 pounds applied to the beam generally longitudinally of the beam and bending strength for bearing a transverse load caused by an air pressure of at least two inches water gauge and applied to the beam generally transversely of the beam, the beam including a central beam and a slide member slidable longitudinally relative to the central beam, selecting first and second locations on the first and second walls, respectively, providing suitable areas for supporting the first and second walls, positioning the first end of the beam at said first location and the second end of the beam at said second location by sliding the slide member relative to the central beam to adjust the length of the beam to correspond to the distance between the first and second walls so that the beam extends between the first and second walls of the mine passageway, securing the bearing member of the first end of the beam to the first wall at said first location and the bearing member at the second end of the beam to the second wall at said second location so that the beam is positioned for supporting the first and second walls, and locking the slide member relative to the central beam after the ends of the beam are secured to respective walls so that the slide member will slide longitudinally relative to the central beam under a longitudinal load greater than about 800 pounds.

17. A method as set forth in claim 16 wherein the slide member is locked relative to the central beam after the ends of the beam are secured to respective walls.

18. A method as set forth in claim 16 wherein the slide member is locked relative to the central beam such that the slide member will slide relative to the central beam under a longitudinal load greater than about 8000 pounds.

19. A method as set forth in claim 16 wherein the slide member is locked relative to the central beam such that the slide member will slide relative to the central beam under a longitudinal load greater than about 16000 pounds.

20. A method of installing a mine stopping between the first and second walls of a mine passageway, said method comprising the steps of:

providing an elongate beam having opposite first and second ends and a longitudinal axis, said beam being configured to have columnar strength for bearing a longitudinal load applied to the beam generally longitudinally of the beam and bending strength for bearing a transverse load applied to the beam generally transversely of the beam, positioning the first end of the beam at a first location on the first wall and the second end of the beam at a second location on the second wall so that the beam extends between the first and second walls of the mine passageway, securing the first end of the beam to the first wall at said first location and the second end of the beam to the second wall at said second location so that said beam is positioned to take a longitudinal load, and erecting a stopping extending between said first and second walls after said beam has been secured to the walls, said erecting step including securing the stopping to the beam so that a load applied to the stopping due to an air pressure differential across the stopping is transferred to said beam as a transverse load.

21. A method as set forth in claim 20 wherein said stopping comprises a plurality of vertically extensible panels positioned side-by-side across the passageway, said erecting step comprising extending each of said panels to bring it into pressure engagement with a floor and roof of the passageway, and then securing the panel in its extended position to said beam.

22. A method as set forth in claim 21 wherein stiffness of the beam and stiffness of said panels are selected such that the beam and at least some of said panels are similarly stressed under the transverse load applied to the stopping so that overstressing of the beam and said panels is inhibited.

23. A method as set forth in claim 21 wherein stiffness of the beam and stiffness of said panels are selected such that for selected panels positioned generally midway across the passageway, extreme fiber stress in the selected panels is at least about 40 percent of the extreme fiber stress in the brace when the transverse load is applied to the stopping so that the beam and said panels are effective to resist the transverse load.

24. A method as set forth in claim 21 wherein stiffness of the beam and stiffness of said panels are selected such that for selected panels positioned generally midway across the passageway, extreme fiber stress in the selected panels is at least about 60 percent of the extreme fiber stress in the brace when the transverse load is applied to the stopping so that the beam and said panels are effective to resist the transverse load.

25. A method as set forth in claim 21 wherein stiffness of the beam and stiffness of said panels are selected such that for selected panels positioned generally midway across the passageway, extreme fiber stress in the selected panels is at least about 80 percent of the extreme fiber stress in the brace when the transverse load is applied to the stopping so that the beam and said panels are effective to resist the transverse load.

26. A method as set forth in claim 20 wherein said securing step comprises drilling holes in the first and second walls at said first and second locations, and using fasteners inserted in said holes to fasten the first and second ends of the beam to respective walls.

27. A method as set forth in claim 20 wherein the central beam and the slide member do not inelastically yield under a longitudinal load of at least about 800 pounds.

28. A method as set forth in claim 27 wherein the beam does not inelastically yield under a transverse load caused by an air pressure of at least about two inches water gauge.

29. A method as set forth in claim 20 wherein the central beam and the slide member do not inelastically yield under a longitudinal load of at least about 4000 pounds.

30. A method as set forth in claim 29 wherein the beam not inelastically yield under a transverse load caused by an air pressure of at least about five inches water gauge.

* * * * *